US009982892B2

(12) United States Patent
Romig et al.

(10) Patent No.: US 9,982,892 B2
(45) Date of Patent: May 29, 2018

(54) FUEL NOZZLE ASSEMBLY INCLUDING A PILOT NOZZLE

(71) Applicant: General Electric Company, Schenectady, NY (US)

(72) Inventors: Bryan Wesley Romig, Simpsonville, SC (US); Dereck Joseph Ouellet, Mason, OH (US); Jason Thurman Stewart, Greer, SC (US); Michael Christopher Gibson, Spartanburg, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 244 days.

(21) Appl. No.: 14/688,170

(22) Filed: Apr. 16, 2015

(65) Prior Publication Data

US 2016/0305668 A1 Oct. 20, 2016

(51) Int. Cl.

| | |
|---|---|
| ***F23R 3/28*** | (2006.01) |
| ***F23R 3/34*** | (2006.01) |
| ***F23R 3/14*** | (2006.01) |

(52) U.S. Cl.

CPC ..... *F23R 3/343* (2013.01); *F23R 3/14* (2013.01); *F23R 3/286* (2013.01); *F23R 2900/03343* (2013.01)

(58) Field of Classification Search

CPC .... F23R 3/34; F23R 3/343; F23R 3/14; F23R 3/286; F23R 2900/03343

See application file for complete search history.

(56) References Cited

U.S. PATENT DOCUMENTS

| | | | | |
|---|---|---|---|---|
| 4,100,733 | A | 7/1978 | Striebel et al. | |
| 4,589,260 | A | 5/1986 | Krockow | |
| 4,850,194 | A * | 7/1989 | Fuglistaller | F23D 11/00 60/737 |

(Continued)

FOREIGN PATENT DOCUMENTS

| | | |
|---|---|---|
| EP | 2405201 A2 | 1/2012 |
| EP | 2693123 A1 | 2/2014 |
| WO | WO 2014/081334 | 5/2014 |

OTHER PUBLICATIONS

U.S. Non-Final Office Action issued in connection with related U.S. Appl. No. 14/102,846 dated Mar. 24, 2016.

(Continued)

*Primary Examiner* — Steven Sutherland
(74) *Attorney, Agent, or Firm* — Dority & Manning, PA

(57) ABSTRACT

A fuel nozzle assembly includes a center body having a pilot air passage and a pilot fuel passage defined therein. A pilot nozzle having a plurality of premix passages is disposed within a downstream end portion of the center body. Each premix passage includes an inlet that is in fluid communication with the pilot air passage, an outlet that is positioned axially downstream from the inlet and a fuel port that is in fluid communication with the pilot fuel passage. An outer sleeve is coaxially aligned with and radially spaced from the center body so as to define an annular passage therebetween. A strut extends radially outwardly from the center body to the outer sleeve. The fuel nozzle assembly further includes an inlet passage that is in fluid communication with the pilot air passage. The inlet passage extends through the outer sleeve, the strut and the center body.

14 Claims, 5 Drawing Sheets

(56) References Cited

U.S. PATENT DOCUMENTS

| | | | | |
|---|---|---|---|---|
| 4,890,453 | A * | 1/1990 | Iwai | F23D 14/24 60/39.465 |
| 4,982,570 | A | 1/1991 | Waslo et al. | |
| 5,199,265 | A | 4/1993 | Borkowicz | |
| 5,235,814 | A | 8/1993 | Leonard | |
| 5,263,325 | A | 11/1993 | McVey et al. | |
| 5,675,971 | A | 10/1997 | Angel et al. | |
| 5,755,090 | A | 5/1998 | Hu | |
| 5,901,555 | A | 5/1999 | Mandai et al. | |
| 6,298,667 | B1 | 10/2001 | Glynn et al. | |
| 6,363,724 | B1 * | 4/2002 | Bechtel | F23D 14/22 239/418 |
| 6,438,961 | B2 | 8/2002 | Tuthill et al. | |
| 6,446,439 | B1 | 9/2002 | Kraft et al. | |
| 6,609,380 | B2 | 8/2003 | Mick et al. | |
| 6,857,271 | B2 | 2/2005 | Kraft et al. | |
| 7,007,477 | B2 | 3/2006 | Widener | |
| 7,854,121 | B2 | 12/2010 | Vandale et al. | |
| 8,240,150 | B2 | 8/2012 | Varatharajan et al. | |
| 8,347,631 | B2 | 1/2013 | Bailey et al. | |
| 8,919,673 | B2 | 12/2014 | Subramanian et al. | |
| 9,297,535 | B2 | 3/2016 | Uhm et al. | |
| 2005/0229600 | A1 * | 10/2005 | Kastrup | F23R 3/14 60/748 |
| 2009/0165436 | A1 | 7/2009 | Herbon et al. | |
| 2009/0223228 | A1 | 9/2009 | Romoser | |
| 2010/0031661 | A1 | 2/2010 | Varatharajan et al. | |
| 2010/0084490 | A1 | 4/2010 | Zuo et al. | |
| 2010/0293954 | A1 | 11/2010 | Widener | |
| 2010/0293955 | A1 | 11/2010 | Berry et al. | |
| 2010/0319353 | A1 | 12/2010 | Intile | |
| 2011/0005229 | A1 | 1/2011 | Venkataraman et al. | |
| 2011/0162371 | A1 | 7/2011 | Khan et al. | |
| 2011/0252803 | A1 | 10/2011 | Subramanian et al. | |
| 2012/0073302 | A1 | 3/2012 | Myers et al. | |
| 2012/0096866 | A1 | 4/2012 | Khan et al. | |
| 2012/0167586 | A1 | 7/2012 | Bailey et al. | |
| 2012/0192565 | A1 | 8/2012 | Tretyakov et al. | |
| 2013/0219899 | A1 | 8/2013 | Uhm et al. | |
| 2013/0219903 | A1 | 8/2013 | Koizumi et al. | |
| 2013/0306181 | A1 | 11/2013 | Mitchell et al. | |
| 2013/0312422 | A1 | 11/2013 | Westmoreland et al. | |
| 2014/0041389 | A1 | 2/2014 | Kajimura et al. | |
| 2014/0190168 | A1 | 7/2014 | Shershnyov | |
| 2015/0159875 | A1 | 6/2015 | Berry et al. | |
| 2016/0313006 | A1 | 10/2016 | Stewart | |

OTHER PUBLICATIONS

U.S. Notice of Allowance issued in connection with related U.S. Appl. No. 14/102,846 dated Jul. 6, 2016.

European Search Report and Opinion issued in connection with corresponding EP Application No. 16165555.0 dated Sep. 13, 2016.

GB Search Report and Opinion issued in connection with corresponding GB Application No. 1606106.1 dated Oct. 13, 2016.

U.S. Non-Final Office Action issued in connection with related U.S. Appl. No. 14/555,143 dated Nov. 31, 2016.

Copending U.S. Appl. No. 14/555,074, Michael Christopher Gibson, filed Nov. 26, 2014.

Copending U.S. Appl. No. 14/555,143, Jason Thurman Stewart, filed Nov. 26, 2014.

Co-pending U.S. Appl. No. 15/221,747, Berry et al., filed Jul. 28, 2016.

* cited by examiner

FUEL NOZZLE ASSEMBLY INCLUDING A PILOT NOZZLE

FIELD OF THE INVENTION

The present invention generally relates to a fuel nozzle assembly for use in a combustor of a gas turbine. More particularly, this invention relates to a fuel nozzle assembly having a premix pilot nozzle.

BACKGROUND OF THE INVENTION

A gas turbine generally includes an inlet section, a compressor section, a combustion section, a turbine section and an exhaust section. The inlet section cleans and conditions a working fluid (e.g., air) and supplies the working fluid to the compressor section. The compressor section progressively increases the pressure of the working fluid and supplies a compressed working fluid to the combustion section. The compressed working fluid and a fuel are mixed within the combustion section and burned in a combustion chamber to generate combustion gases having a high temperature and pressure. The combustion gases are routed along through a hot gas path into the turbine section where they expand to produce work. For example, expansion of the combustion gases in the turbine section may rotate a shaft connected to a generator to produce electricity.

The combustion section generally includes a plurality of combustors annularly arranged about an outer casing. In lean premix style combustion systems, each combustor includes one or more premix type fuel nozzles. A typical premix fuel nozzle includes a center body that is at least partially surrounded by an outer tube or sleeve. A premix flow passage is defined between the outer sleeve and the center body. Multiple vanes or struts extend between the center body and the outer sleeve within the premix flow passage.

In operation, fuel is injected into compressed air flowing through the premix flow passage. The vanes impart angular swirl to the compressed air thus enhancing mixing with the fuel upstream from a combustion zone of the combustor. The premixed fuel-air is generally a fuel-lean mixture. The fuel-lean mixture burns more efficiently, thus reducing CO emissions and producing lower NOx emissions than diffusion flame technology.

At least one of the premix type fuel nozzles may include a pilot nozzle. The pilot nozzle may be coaxially aligned with and disposed within the center body of the corresponding fuel nozzle upstream from the combustion zone. During particular combustion operation modes, the pilot nozzle may deliver a premixed fuel and air mixture to the combustion zone to produce a premixed pilot flame. The premixed pilot flame is generally used to ensure flame stability as the combustor is operated in certain modes and/or when the combustor transitions between various modes of operation.

In order for the pilot nozzle to function, pilot or compressed air and pilot fuel must be supplied through the center body to the pilot nozzle. However, space restrictions within the center body may limit possibilities for routing the pilot air and fuel to the pilot nozzle, thus potentially limiting overall effectiveness of the pilot nozzle. Therefore, an improved fuel nozzle assembly having a pilot nozzle would be useful in the technology.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle assembly. The fuel nozzle assembly includes a center body that extends axially along a centerline of the fuel nozzle assembly. The center body includes a pilot air passage and a pilot fuel passage defined therein. A pilot nozzle is disposed within a downstream end portion of the center body. The pilot nozzle includes and/or defines a plurality of premix passages. Each premix passage includes an inlet that is in fluid communication with the pilot air passage, an outlet that is positioned axially downstream from the inlet and a fuel port that is in fluid communication with the pilot fuel passage. An outer sleeve is coaxially aligned with and radially spaced from the center body and defines an annular passage therebetween. A strut extends radially outwardly from the center body to the outer sleeve. The fuel nozzle assembly further includes an inlet passage that is in fluid communication with the pilot air passage. The inlet passage extends through the outer sleeve, the strut and the center body.

Another embodiment of the present invention is a combustor for a gas turbine. The combustor generally includes an end cover that is coupled to an outer casing. The end cover and the outer casing at least partially define or form a head end portion of the combustor. The head end is in fluid communication with a compressor of the gas turbine. The combustor also includes a fuel nozzle assembly that is connected to the end cover and that extends axially within the head end portion of the combustor. The fuel nozzle includes a center body that extends axially along a centerline of the fuel nozzle assembly. The center body includes a pilot air passage and a pilot fuel passage that are defined therein. A pilot nozzle is disposed within a downstream end portion of the center body and includes a plurality of premix passages. Each premix passage has an inlet that is in fluid communication with the pilot air passage, an outlet that is disposed downstream from the inlet and a fuel port that is in fluid communication with the pilot fuel passage. The fuel nozzle further includes an outer sleeve that is coaxially aligned with and radially spaced from the center body so as to define an annular passage therebetween. A strut extends radially outwardly from the center body to the outer sleeve. The fuel nozzle assembly further includes an inlet passage that is in fluid communication with the pilot air passage and the head end portion of the combustor. The inlet passage extends through the outer sleeve, the strut and the center body.

Another embodiment of the present invention is a fuel nozzle assembly. The fuel nozzle assembly includes a center body that extends axially along a centerline of the fuel nozzle assembly. The center body includes an annular pilot air passage and an annular pilot fuel passage defined within the center body. The pilot air passage is defined radially outwardly from the pilot fuel passage. The fuel nozzle assembly further includes a base portion that is in fluid communication with the pilot air passage and that is configured to receive pilot air from an end cover of a combustor. A pilot nozzle is disposed within a downstream end portion of the center body. The pilot nozzle includes and/or defines a plurality of premix passages. Each premix passage includes an inlet that is in fluid communication with the pilot air passage, an outlet that is downstream from the inlet and a fuel port in that is fluid communication with the pilot fuel passage.

Another embodiment of the present invention includes a combustor. The combustor includes an end cover that is coupled to an outer casing. The end cover and the outer casing form a head end portion of the combustor. The combustor also includes a fuel nozzle assembly that is connected to the end cover and that extends axially within the head end portion of the combustor. The fuel nozzle includes a center body that extends axially along a centerline of the fuel nozzle assembly. The center body includes an annular pilot air passage and an annular pilot fuel passage defined within the center body. The pilot air passage is defined radially outwardly from the pilot fuel passage. The fuel nozzle assembly further includes a base portion that is in fluid communication with the pilot air passage and that is configured to receive pilot air from the end cover. The fuel nozzle further includes a pilot nozzle that is disposed within a downstream end portion of the center body. The pilot nozzle includes or defines a plurality of premix passages. Each premix passage includes an inlet that is in fluid communication with the pilot air passage, an outlet disposed downstream from the inlet and a fuel port that is in fluid communication with the pilot fuel passage.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
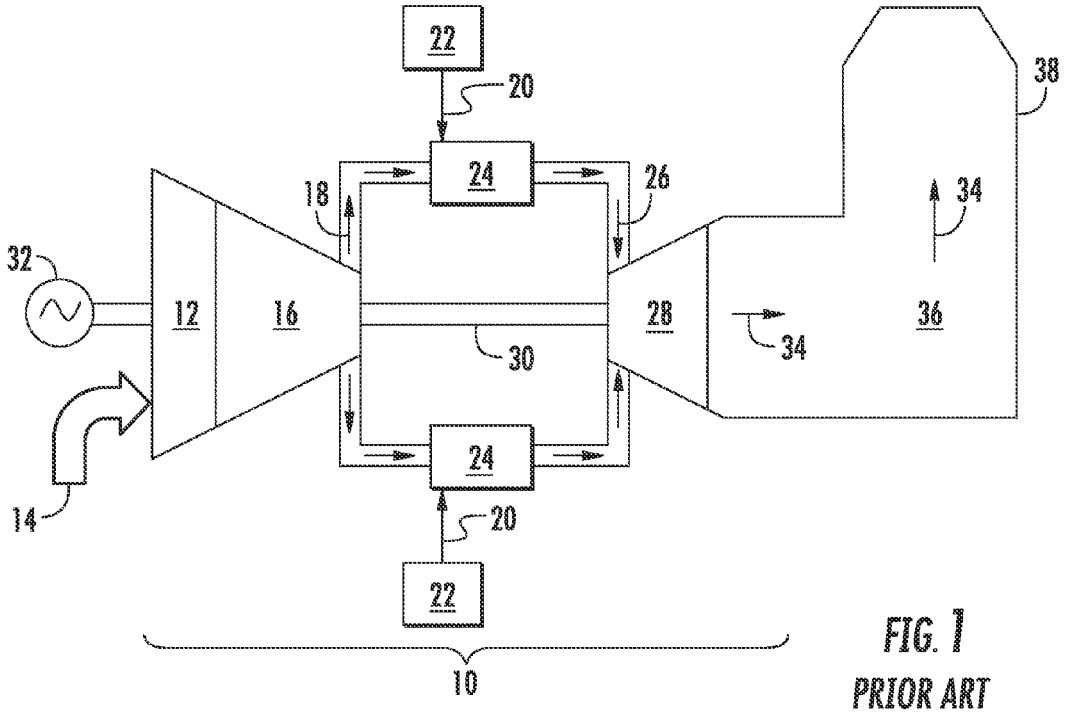
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a premix fuel nozzle assembly for a land based power generating gas turbine combustor for purposes of illustration, one of ordinary skill in the art will readily appreciate that embodiments of the present invention may be applied to any style or type of combustor for a turbomachine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
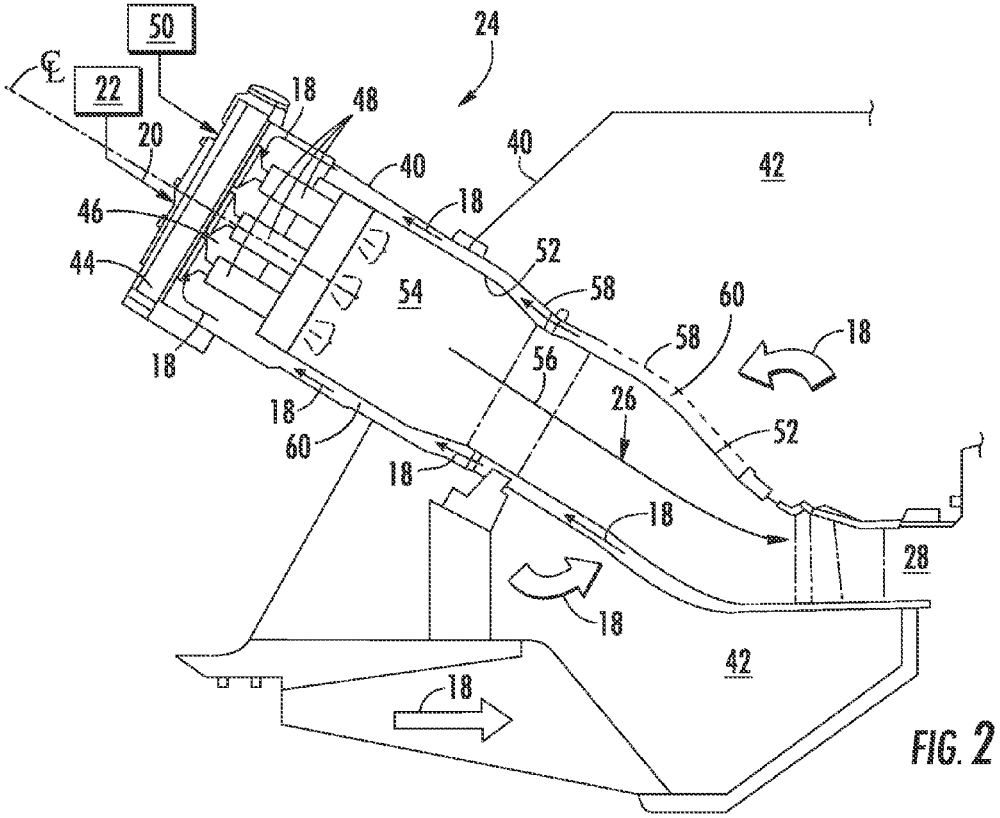
FIG. 2 is a simplified cross-section side view of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 24 as may be incorporated in the gas turbine 10 shown in FIG. 1 and as may incorporate one or more embodiments of the present invention.

In an exemplary embodiment, as shown in FIG. 2, the combustor 24 is at least partially surrounded by an outer casing 40 such as a compressor discharge casing. The outer casing 40 may at least partially define a high pressure plenum 42 that at least partially surrounds the combustor 24. The high pressure plenum 42 is in fluid communication with the compressor 16 (FIG. 1) so as to receive the compressed air 18 therefrom. An end cover 44 may be coupled to the outer casing 40. The outer casing 40 and the end cover 44 may at least partially define a head end portion 46 of the combustor 24.

One or more fuel nozzle assemblies 48 extend axially downstream from the end cover 44 within and/or through the head end 46. At least some of the fuel nozzle assemblies may be in fluid communication with the fuel supply system 22 via the end cover 44. In particular embodiments, at least one of the fuel nozzle assemblies 48 may be in fluid communication with an extraction air supply 50 for example, via the end cover 44.

The combustor 24 may also include one or more liners 52 such as a combustion liner and/or a transition duct that at least partially define a combustion chamber 54 within the outer casing 40. The liner(s) 52 may also at least partially define a hot gas path 56 for directing the combustion gases 26 into the turbine 28. In particular configurations, one or more flow or impingement sleeves 58 may at least partially surround the liner(s) 52. The flow sleeve(s) 58 may be radially spaced from the liner(s) 52 so as to define an annular flow path 60 for directing a portion of the compressed air 18 towards the head end portion 46 of the combustor 24.

Figure 3:
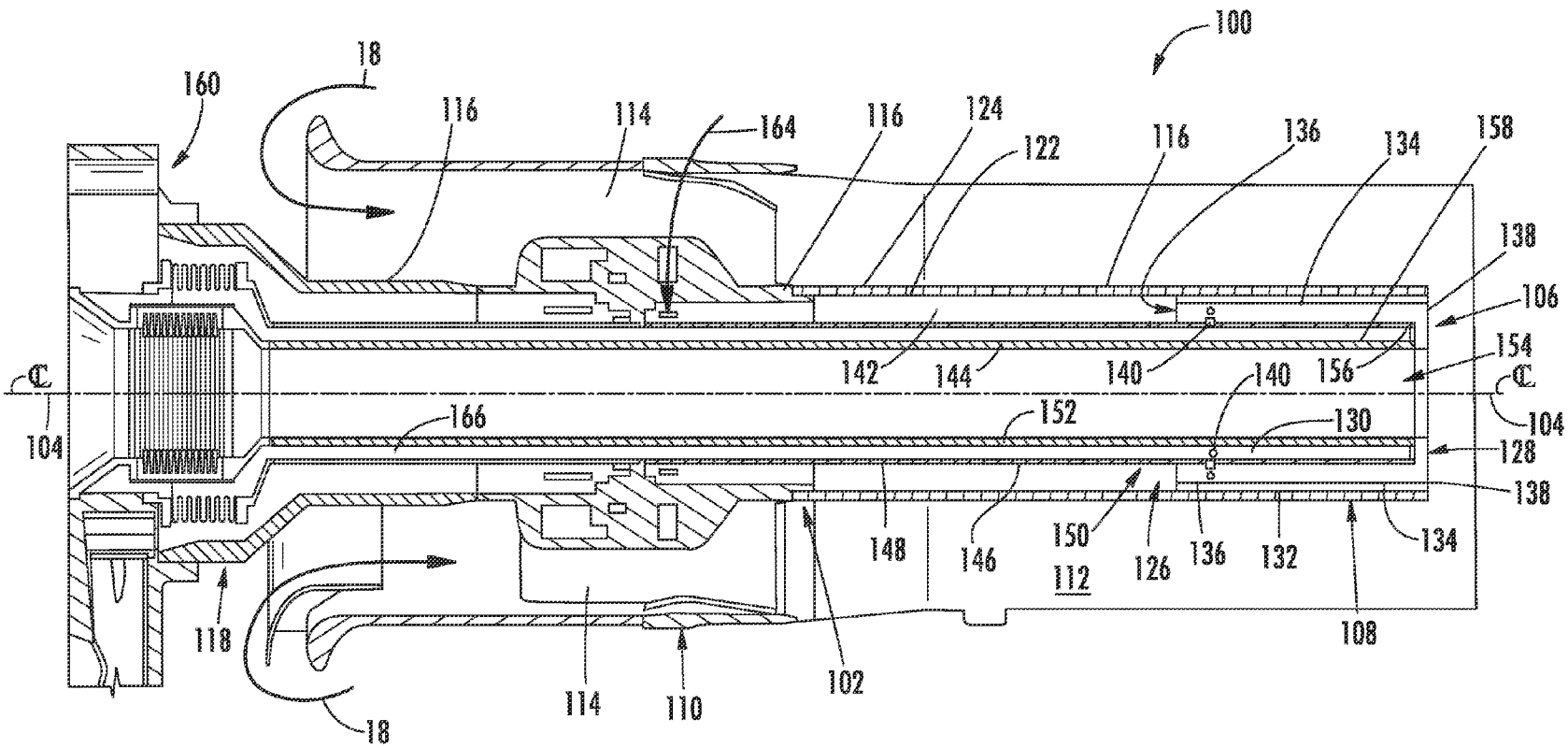
FIG. 3 is a cross sectioned perspective view of an exemplary fuel nozzle assembly according to one embodiment of the present invention.

FIG. 3 provides a cross sectioned side view of an exemplary premix type fuel nozzle assembly 100 according to one or more embodiments of the present invention and as may be incorporated into the combustor 24 as shown in FIG. 2. Fuel nozzle assembly 100 may be representative of one, any or all of the fuel nozzle assemblies 48 shown in FIG. 2 and is not limited to any particular location or position along the end cover 44 or within the combustor 24 unless otherwise recited in the claims. In particular embodiments, the fuel nozzle assembly 100 may be configured as a "dual fuel" type fuel nozzle assembly, as a result, the fuel nozzle assembly 100 as provided herein may be configured or modified to burn or operate on either a gaseous fuel or a liquid fuel.

In particular embodiments, as shown in FIG. 3, the fuel nozzle assembly 100 includes a center body 102 that extends axially along a centerline 104 of the fuel nozzle assembly 100, a pilot nozzle 106 disposed within a downstream end portion 108 of the center body 102, an outer sleeve 110 that is coaxially aligned with and radially spaced from the center body 102 so as to define an annular passage 112 therebetween and at least one strut or swirler vane 114 that extends radially outwardly from the center body 102 to the outer sleeve 110. The strut 114 may be configured to impart angular swirl to a portion of the compressed air 18 flowing through the annular passage 112.

The center body 102 is generally annular and may comprise of a singular tube 116 or a plurality of tubes 116 joined together to form a singular or continuous center body 102. The center body 102 generally includes an upstream end portion 118 that is axially spaced from the downstream end portion 108. The center body 102 may also include an inner surface 122 that is radially spaced from an outer surface 124.

In various embodiments, the pilot nozzle 106 is generally annular and includes an upstream end or portion 126 that is axially spaced from a downstream end or portion 128. The pilot nozzle 106 further includes an inner wall 130 that is radially spaced from an outer wall 132. In particular embodiments, the outer wall 132 of the pilot nozzle 106 is slideably engaged with the inner surface 122 of the center body 102, thus allowing for axial thermal growth or contraction of the pilot nozzle 106 with respect to the center body 102 during operation of the combustor 24.

In various embodiments, the pilot nozzle 106 includes a plurality of premix passages 134 that extend substantially axially through the pilot nozzle 106. Each premix passage 134 includes an inlet 136 that is defined and/or disposed along the upstream end portion 126 of the pilot nozzle 106 and an outlet 138 that is defined and/or disposed along the downstream end portion 128 of the pilot nozzle 106. The outlet 138 is formed downstream from the inlet 136. In particular embodiments, the plurality of premix passages 134 is annularly arranged about the centerline 104 of the fuel nozzle assembly 100 between the inner wall 130 and the outer wall 132 of the pilot nozzle 106. Each premix passage 134 includes at least one fuel port 140 defined between the corresponding inlet 136 and outlet 138.

In various embodiments, the fuel nozzle assembly 100 includes a pilot air passage 142 and a pilot fuel passage 144 that are defined concentrically within the center body 102. In particular embodiments, the pilot air passage 142 is disposed or formed radially outwardly from the pilot fuel passage 144. One or more of the inlets 136 of the premix passages 134 are in fluid communication with the pilot air passage 142. In particular embodiments, the pilot air passage 142 is defined between an intermediate tube 146 and the center body 102. The intermediate tube 146 extends coaxially within the center body 102. For example, the pilot air passage 142 may be defined between an outer surface 148 of the intermediate tube 146 and the inner surface 122 of the center body 102. In particular embodiments, a downstream end 150 of the intermediate tube 146 is sealed and/or fixedly connected to the upstream end portion 126 of the pilot nozzle 106. In one embodiment, the downstream end 150 of the intermediate tube 146 is sealed and/or fixedly connected to the upstream end portion 126 of the pilot nozzle 106 radially inwardly from the inlets 136 of the premix passages 134.

In various embodiments, as shown in FIG. 3, the pilot fuel passage 144 is defined within the center body 102 between an inner tube 152 and the intermediate tube 146. The pilot fuel passage 144 is in fluid communication with the premix passages 134 via the fuel ports 140. As shown in FIG. 3, the inner tube 152 and the intermediate tube 146 may extend coaxially within the center body 102. In particular embodiments, a portion of the inner tube 152 extends at least partially through the pilot nozzle 106.

In one embodiment, a downstream end 154 of the inner tube 152 forms a seal against an inner surface 156 of the downstream end 128 of the pilot nozzle 106. In this configuration, a portion the pilot fuel passage 144 is at least partially defined between an outer surface 158 of the inner tube 152 and the inner wall 130 of the pilot nozzle 106. In particular embodiments, the inner tube extends axially from a base portion 160 of the fuel nozzle assembly 100. The base portion 160 may be configured to connect to the end cover 44. In one embodiment, the pilot fuel passage 144 is in fluid communication with the end cover 44 (FIG. 2).

Figure 4:
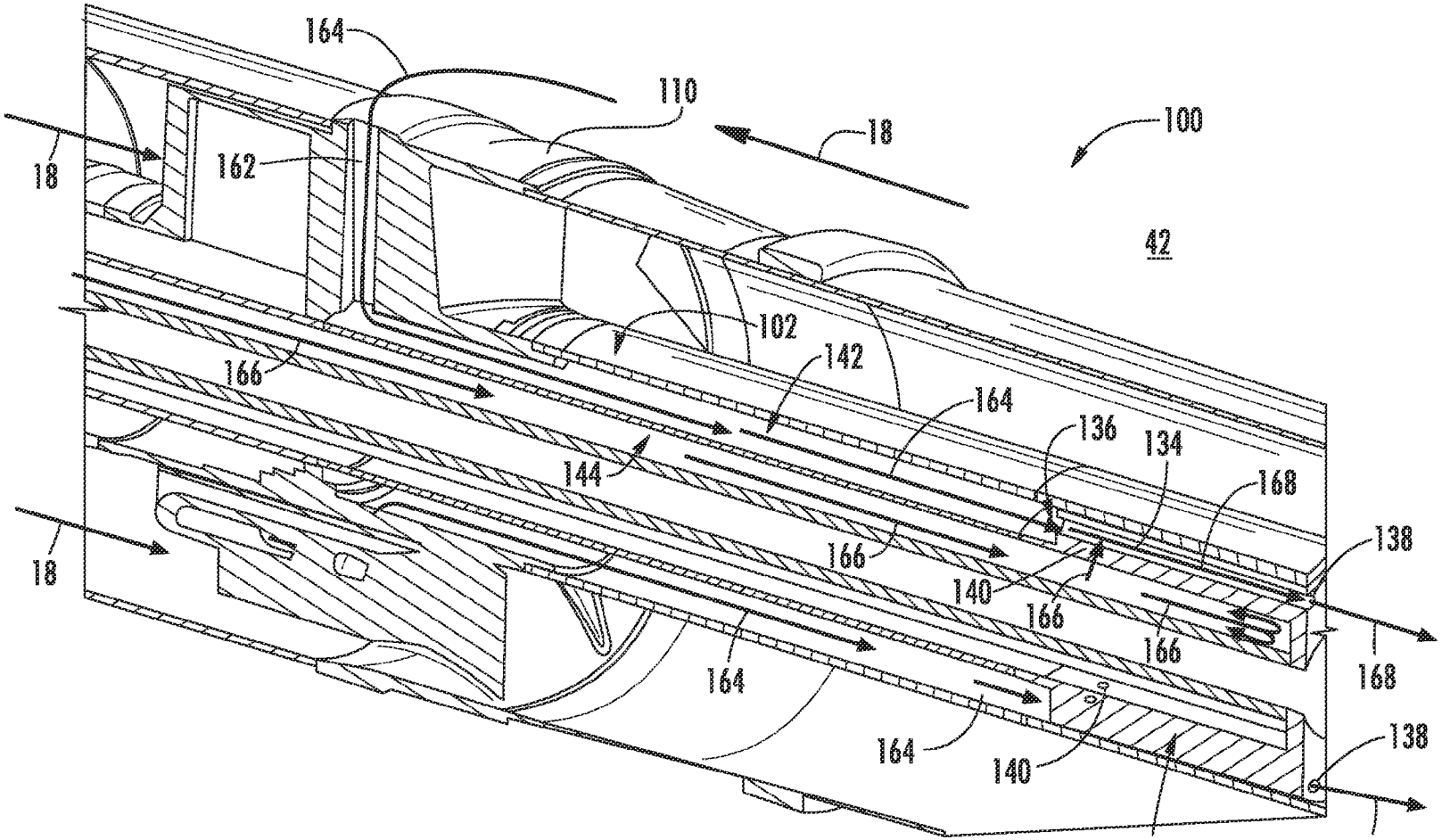
FIG. 4 is a cross sectioned perspective side view of a portion of the fuel nozzle assembly as shown in FIG. 3, according to one embodiment of the present invention.

FIG. 4 provides a cross sectioned perspective view of a portion of the fuel nozzle assembly 100 as shown in FIG. 3, according to various embodiments of the present invention. In various embodiments, as shown in FIG. 4, the fuel nozzle assembly 100 includes an inlet passage 162 that is in fluid communication with the pilot air passage 142. In particular embodiments, the inlet passage 162 extends through the outer sleeve 110, the strut 114 and the center body 102.

In operation, as provided collectively in FIGS. 3 and 4, a portion of the compressed air 18 from the high pressure plenum 42 (FIG. 2) flows through the inlet passage 162 to provide a flow of pilot air as indicated by arrows 164 into the pilot air passage 142. The pilot air 164 flows into the premix passages 134 via the inlets 136. Pilot fuel as indicated by arrows 166 is provided to the pilot fuel passage 144 via the end cover 44 (FIG. 2). The pilot fuel 166 flows towards the pilot nozzle 106 and is injected into the premix passages 134 via fuel ports 140. The pilot air and pilot fuel mix within the premix passages 134. A premixed pilot fuel-air mixture as indicated by arrows 168 exits the outlets 138 of the premix passages 134. The premixed pilot fuel-air mixture 168 may be ignited and burned as it exits the outlets 138.

Figure 5:
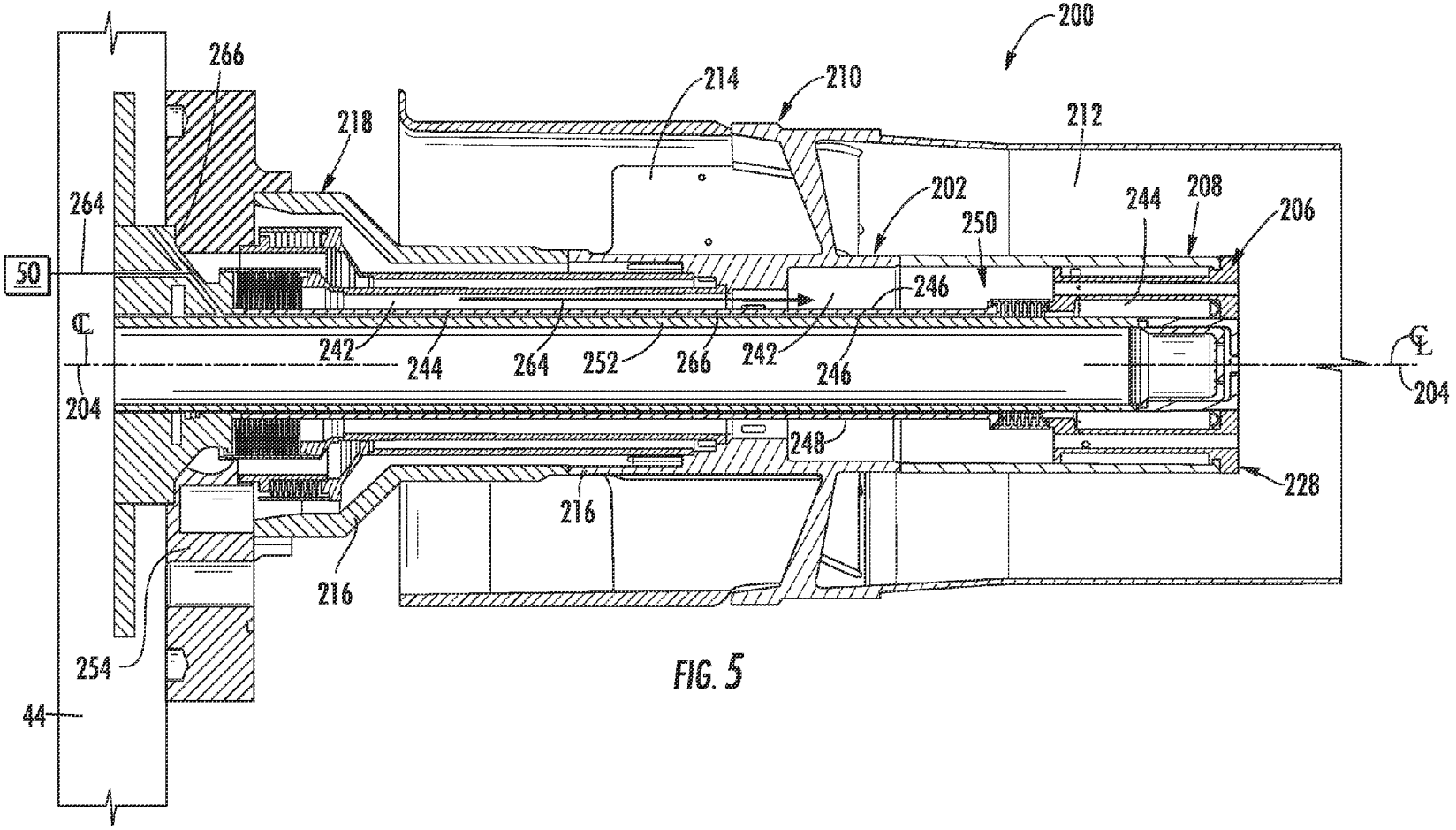
FIG. 5 is a cross sectioned perspective view of an exemplary fuel nozzle assembly according to one embodiment of the present invention.

FIG. 5 provides a cross sectioned side view of an exemplary premix type fuel nozzle assembly 200 according to one or more embodiments of the present invention and as may be incorporated into the combustor 24 as shown in FIG. 2. Fuel nozzle assembly 200 may be representative of one, any or all of the fuel nozzle assemblies 48 shown in FIG. 2 and is not limited to any particular location or position along the end cover 44 or within the combustor 24 unless otherwise recited in the claims. In particular embodiments, the fuel nozzle assembly 200 may be configured as a "dual fuel" type fuel nozzle assembly, as a result, the fuel nozzle assembly 200 as provided herein may be configured or modified to burn or operate on either a gaseous fuel or a liquid fuel.

In particular embodiments, as shown in FIG. 5, the fuel nozzle assembly 200 includes a center body 202 that extends axially along a centerline 204 of the fuel nozzle assembly 200, a pilot nozzle 206 disposed within a downstream end portion 208 of the center body 202, an outer sleeve 210 that is coaxially aligned with and radially spaced from the center body 200 so as to define an annular passage 212 therebetween and at least one strut or swirler vane 214 that extends radially outwardly from the center body 202 to the outer sleeve 210. The strut 214 may be configured to impart angular swirl to a portion of the compressed air 18 flowing through the annular passage 212.

The center body 202 is generally annular and may comprise of a singular tube 216 or a plurality of tubes 216 joined together to form a singular or continuous center body 202. The center body 202 generally includes an upstream end portion 218 that is axially spaced from the downstream end portion 208. The center body 202 may also include an inner surface 222 that is radially spaced from an outer surface 224.

Figure 6:
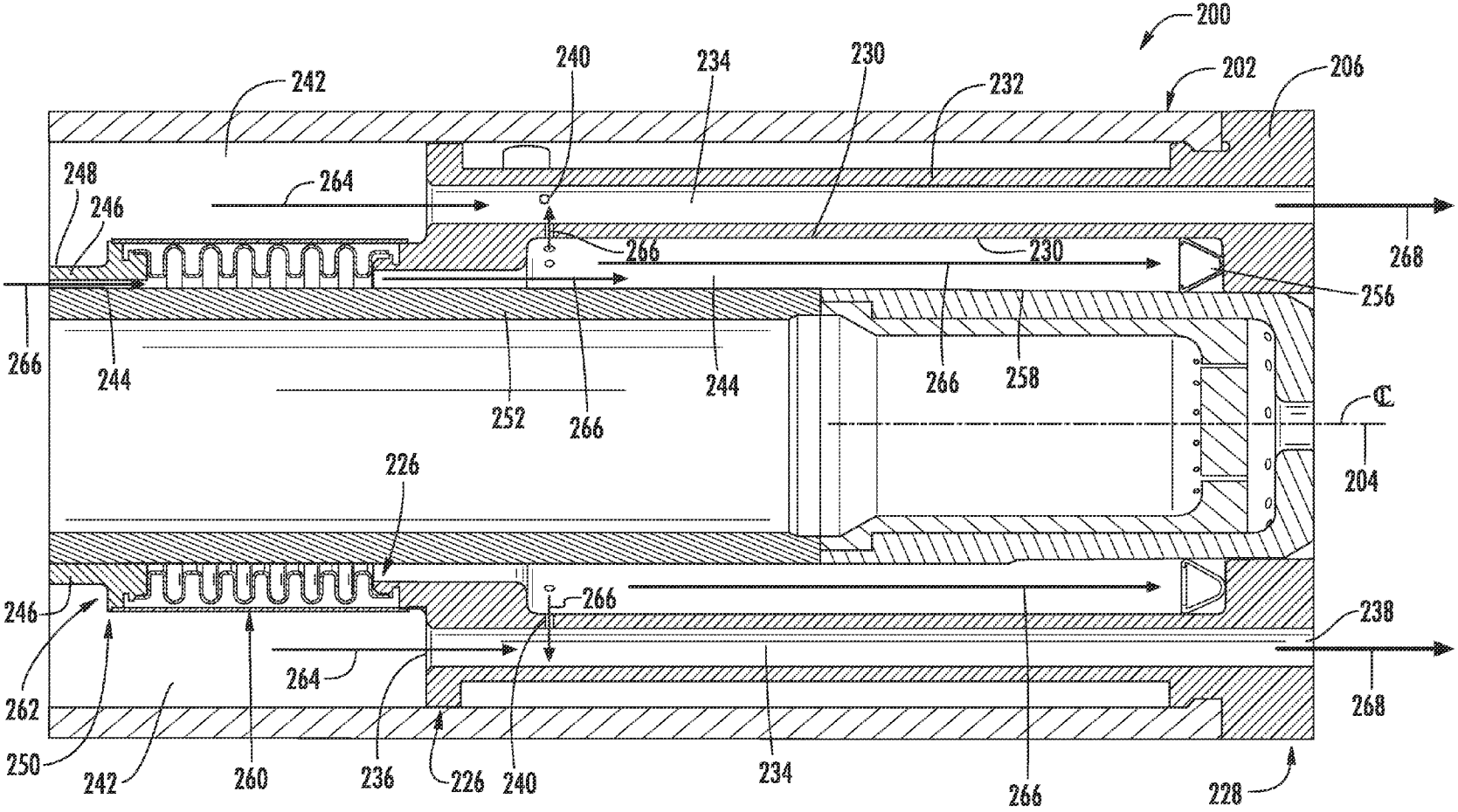
FIG. 6 is an enlarged cross sectioned side view of a portion of the fuel nozzle assembly as shown in FIG. 5, according to various embodiments of the present invention.

FIG. 6 is an enlarged cross sectioned side view of a portion the fuel nozzle assembly 200 as shown in FIG. 5, according to at least one embodiment of the present invention. In various embodiments, as shown in FIG. 6, the pilot nozzle 206 is generally annular and includes an upstream end or portion 226 that is axially spaced from a downstream end or portion 228. The pilot nozzle 206 further includes an inner wall 230 that is radially spaced from an outer wall 232. In particular embodiments, the pilot nozzle 206 is fixedly connected to the center body 202. For example, the pilot nozzle 206 may be welded or brazed to the center body 202.

In various embodiments, the pilot nozzle 206 includes a plurality of premix passages 234 that extend substantially axially through the pilot nozzle 206. Each premix passage 234 includes an inlet 236 that is defined and/or disposed along the upstream end portion 226 of the pilot nozzle 206 and an outlet 238 that is defined and/or disposed along the downstream end portion 228 of the pilot nozzle 206. The outlet 238 is formed downstream from the inlet 236. In particular embodiments, the plurality of premix passages 234 is annularly arranged about the centerline 204 of the fuel nozzle assembly 200 between the inner wall 230 and the outer wall 232 of the pilot nozzle 206. Each premix passage 234 includes at least one fuel port 240 defined between the inlet 236 and outlet 238 of the corresponding premix passage 234.

In various embodiments, as shown in FIGS. 5 and 6, the fuel nozzle assembly 200 includes a pilot air passage 242 and a pilot fuel passage 244 that are defined concentrically within the center body 202. In particular embodiments, the pilot air passage 242 is disposed or formed radially outwardly from the pilot fuel passage 244. One or more of the inlets 236 of the premix passages 234 are in fluid communication with the pilot air passage 242. In particular embodiments, the pilot air passage 242 is defined between an intermediate tube 246 and the center body 202. The intermediate tube 246 extends coaxially within the center body 202.

The pilot air passage 242 may be defined between an outer surface 248 of the intermediate tube 246 and the inner surface 222 of the center body 202. In particular embodiments, a downstream end 250 of the intermediate tube 246 is sealed and/or fixedly connected to the upstream end portion 226 of the pilot nozzle 206. In one embodiment, the downstream end 250 of the intermediate tube 246 is sealed and/or fixedly connected to the upstream end portion 226 of the pilot nozzle 206 radially inwardly from the inlets 236 of the premix passages 234. In various embodiments, as shown in FIGS. 5 and 6, the pilot fuel passage 244 is defined within the center body 202 between an inner tube 252 and the intermediate tube 246.

In particular embodiments as shown in FIG. 5, the inner tube 252 is a cartridge that is breach loaded into the center body 202. For example, the cartridge may be a purge air or duel fuel type cartridge. As shown in FIG. 6, the pilot fuel passage 244 is in fluid communication with the premix passages 234 via the fuel ports 240. As shown in FIG. 5, the inner tube 252 and the intermediate tube 246 may extend coaxially within the center body 202. The inner tube 252 and the intermediate tube 246 extend axially from a base portion 254 of the fuel nozzle assembly 200 towards and/or to the pilot nozzle 206. The base portion 254 may be configured to connect to the end cover 44. In one embodiment, the pilot fuel passage 244 and the pilot air passage 242 are in fluid communication with the end cover 44.

In particular embodiments, as shown in FIG. 6, a portion of the inner tube 252 extends at least partially through the pilot nozzle 206. In particular embodiments, an annular or radial seal 256 may extend between an outer surface 258 of the inner tube 252 and the inner wall 230 of the pilot nozzle 206. The seal 256 may be a piston seal, a lip seal or any seal suitable for its intended purpose therein. The seal 256 generally extends circumferentially around the outer surface 258 of the inner tube 252 and seals against the inner wall 230 of the pilot nozzle 206. In particular embodiments, the pilot fuel passage 244 is at least partially defined between the inner wall 230 of the nozzle tip 206, the outer surface 258 of the inner tube 252 and the seal 256.

In particular embodiments, as shown in FIG. 6, the fuel nozzle assembly 200 includes an annular shaped expansion member 260 such as a bellows spring that is coupled at one end to a downstream end 262 of the intermediate tube 246 and at an axially opposing end to the upstream end portion 226 of the pilot nozzle 206. The expansion member 260 may be disposed radially inwardly from the inlets 236 of the premix passages 234. The expansion member 260 allows for thermal expansion of the intermediate tube 246 along the centerline 204 with respect to the pilot nozzle 206 during operation of the fuel nozzle assembly 200.

In operation, as shown collectively in FIGS. 5 and 6, pilot air as indicated by arrows 264 is routed from the extraction air supply 50 through the end cover 44 (FIG. 2) and into the pilot air passage 242. As shown in FIG. 6, the pilot air 264 flows into the premix passages 234 via the inlets 236 of the pilot nozzle 206. As shown in FIG. 5, pilot fuel as indicated by arrows 266 is provided to the pilot fuel passage 244 via the end cover 44 (FIG. 2). Referring back to FIG. 6, the pilot fuel 266 flows towards the pilot nozzle 206 and is injected into the premix passages 234 via fuel ports 240. The pilot air 264 and pilot fuel 266 mix within the premix passages 234. As shown in FIG. 6, a premixed pilot fuel-air mixture as indicated by arrows 268 exits the outlets 238 of the premix passages 234. The premixed pilot fuel-air mixture 268 may be ignited and burned as it exits the outlets 238.

The fuel nozzle assemblies 100, 200 as provided herein provide for various technical advantages over existing fuel nozzle assemblies which incorporate pilot nozzles. For example, the inner tube or cartridge 152, 252 and the intermediate tube 146, 246 create passages required to provide the pilot air 164, 264 and pilot fuel 166, 266 to the pilot nozzle 106, 206. The expansion member 260 in fuel nozzle assembly 200 accounts for thermal expansion due to temperature differences in the pilot air 264 and the pilot fuel 266. With regards to fuel nozzle assembly 100, the outer wall 132 of the pilot nozzle 106 may slide or move relative to the center body 102 to account for thermal expansion due to temperature differences in the pilot air 164 and the pilot fuel 166. In addition, the pilot nozzle 106, 206 may be removed from the center body 102, 202 to allow for repair and/or replacement of the pilot nozzle 106, 206.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A fuel nozzle assembly, comprising:

a center body that extends axially along a centerline of the fuel nozzle assembly, the center body defining a pilot air passage and a pilot fuel passage defined therein, at least a portion of the pilot fuel passage being defined between an inner tube and an intermediate tube;

a pilot nozzle disposed within a downstream end portion of the center body, an outer wall of the pilot nozzle being slideably engaged with an inner surface of the center body to allow axial thermal growth or contraction between the pilot nozzle and the center body, the pilot nozzle having a plurality of premix passages, each premix passage having an inlet in fluid communication with the pilot air passage, an outlet downstream from the inlet, and a fuel port in fluid communication with the pilot fuel passage, wherein a downstream end of the inner tube is sealed to an inner surface of a downstream portion of the pilot nozzle;

an outer sleeve coaxially aligned with and radially spaced from the center body so as to define an annular passage therebetween;

a strut that extends radially outwardly from the center body to the outer sleeve; and an inlet passage in fluid communication with the pilot air passage, wherein the inlet passage extends through the outer sleeve, the strut and the center body.

2. The fuel nozzle assembly as in claim 1, wherein the strut is a swirler vane.

3. The fuel nozzle as in claim 1, wherein the plurality of premix passages is annularly arranged about an axial centerline of the fuel nozzle assembly between an inner wall and the outer wall of the pilot nozzle.

4. The fuel nozzle assembly as in claim 3, wherein a downstream end of the intermediate tube is sealed to an upstream portion of the pilot nozzle radially inward from the inlets of the premix passages.

5. The fuel nozzle assembly as in claim 1, wherein the pilot air passage is defined between the intermediate tube that extends coaxially within the center body and the inner surface of the center body.

6. The fuel nozzle assembly as in claim 1, wherein the inner tube and the intermediate tube extend coaxially within the center body.

7. The fuel nozzle assembly as in claim 1, wherein a portion of the fuel passage is at least partially defined between an outer surface of the inner tube and an inner wall of the pilot nozzle.

8. A combustor for a gas turbine, the combustor comprising:

an end cover coupled to an outer casing, wherein the end cover and the outer casing form a head end portion of the combustor, wherein the head end portion is in fluid communication with a compressor of the gas turbine; and a fuel nozzle assembly connected to the end cover and extending axially within the head end portion of the combustor, the fuel nozzle assembly comprising:

a center body that extends axially along a centerline of the fuel nozzle assembly, the center body defining a pilot air passage and a pilot fuel passage defined therein, at least a portion of the pilot fuel passage being defined between an inner tube and an intermediate tube;

a pilot nozzle disposed within a downstream end portion of the center body, an outer wall of the pilot nozzle being slideably engaged with an inner surface of the center body to allow axial thermal growth or contraction between the pilot nozzle and the center body, the pilot nozzle having a plurality of premix passages, each premix passage having an inlet in fluid communication with the pilot air passage, an outlet downstream from the inlet and a fuel port in fluid communication with the pilot fuel passage, wherein a downstream end of the inner tube is sealed to an inner surface of a downstream portion of the pilot nozzle;

an outer sleeve coaxially aligned with and radially spaced from the center body so as to define an annular passage therebetween;

a strut that extends radially outwardly from the center body to the outer sleeve; and an inlet passage in fluid communication with the pilot air passage and the head end portion of the combustor, wherein the inlet passage extends through the outer sleeve, the strut and the center body.

9. The combustor as in claim 8, wherein the strut is a swirler vane.

10. The combustor as in claim 8, wherein the plurality of premix passages is annularly arranged about an axial centerline of the fuel nozzle assembly between an inner wall and the outer wall of the pilot nozzle.

11. The combustor as in claim 8, wherein the pilot air passage is defined between the intermediate tube that extends coaxially within the center body and the inner surface of the center body.

12. The combustor as in claim 11, wherein a downstream end of the intermediate tube is sealed to an upstream portion of the pilot nozzle radially inward from the inlets of the premix passages.

13. The combustor as in claim 8, wherein the inner tube and the intermediate tube extend coaxially within the center body.

14. The combustor as in claim 8, wherein a portion of the fuel passage is at least partially defined between an outer surface of the inner tube and an inner wall of the pilot nozzle.

* * * * *